US007110906B2

(12) United States Patent
Vesel

(10) Patent No.: US 7,110,906 B2
(45) Date of Patent: Sep. 19, 2006

(54) SYSTEM AND METHOD FOR MONITORING THE PERFORMANCE OF A HEAT EXCHANGER

(75) Inventor: Richard W. Vesel, Hudson, OH (US)

(73) Assignee: ABB Inc., Norwalk, CT (US)

( * ) Notice: Subject to any disclaimer, the term of this patent is extended or adjusted under 35 U.S.C. 154(b) by 0 days.

(21) Appl. No.: 10/896,732

(22) Filed: Jul. 22, 2004

(65) Prior Publication Data

US 2006/0020420 A1 Jan. 26, 2006

(51) Int. Cl.
*G01K 13/00* (2006.01)

(52) U.S. Cl. ..... 702/130; 702/99

(58) Field of Classification Search ..... 702/99, 702/130; 165/11.2

See application file for complete search history.

(56) References Cited

U.S. PATENT DOCUMENTS 3,918,300 A * 11/1975 Weisstuch et al. ..... 73/112
4,766,553 A 8/1988 Kaya et al.
5,429,178 A 7/1995 Garey et al.
5,590,706 A 1/1997 Tsou et al.
5,615,733 A 4/1997 Yang
5,992,505 A 11/1999 Moon
6,086,828 A * 7/2000 Thompson ..... 422/173
6,386,272 B1 5/2002 Starner et al.
6,694,513 B1 2/2004 Andersson et al.
2003/0056004 A1 3/2003 Argentieri et al.
2003/0075314 A1* 4/2003 Cryer et al. ..... 165/254

* cited by examiner

*Primary Examiner*—Bryan Bui
*Assistant Examiner*—Jonathan Moffat
(74) *Attorney, Agent, or Firm*—Paul R. Katterle

(57) ABSTRACT

The present invention is directed to a system and method for monitoring the performance of a heat exchanger. In accordance with the system and method, baseline values of a performance factor (E) for baseline sets of heat exchanger operating values are calculated and stored. A current value of E is calculated for a current set of the operating values and is compared to a retrieved baseline value of E for a baseline set of the operating values that at least substantially matches the current set of the operating values. E provides a measure of the performance of the heat exchanger and is calculated using differential temperatures across the heat exchanger and without using any information concerning the physical construction of the heat exchanger.

24 Claims, 6 Drawing Sheets

SYSTEM AND METHOD FOR MONITORING THE PERFORMANCE OF A HEAT EXCHANGER

BACKGROUND OF THE INVENTION

The present invention is directed toward the monitoring of plant assets and, more particularly, toward a system and method for monitoring the performance of a heat exchanger using a heat exchanger model.

Heat exchangers are widely used in a variety of industrial processes to transfer heat between a process fluid and a thermal transfer fluid. This transfer of heat may be performed to heat or cool the process fluid or to change the state of the process fluid. There are three main types of heat exchanger, namely recuperative, regenerative and evaporative. Of these three types, the recuperative type is the most common. In a recuperative heat exchanger, the process fluid and the thermal transfer fluid are separated by structures, such as tubes or plates, through which heat is transferred from one fluid to the other fluid. The transfer of heat between the two fluids occurs through conduction and convection. The most common types of construction for recuperative heat exchangers are shell and tube, plate and spiral. Operatively, recuperative heat exchangers can be single phase or two-phase and can be parallel flow, counter flow, or cross flow.

Regardless of their particular construction or operation, all recuperative heat exchangers are subject to fouling, which is the formation of deposits on the surfaces of the heat transfer structures. Fouling can occur through crystallization, sedimentation, chemical reaction/polymerization, coking, corrosion and/or biological/organic material growth. Fouling reduces the efficiency of a heat exchanger by constricting fluid flow and reducing the heat transfer coefficients of the heat transfer structures. Accordingly, heat exchangers are periodically cleaned to remove fouling. Typically, the cleaning of a heat exchanger is performed according to a predetermined maintenance schedule. Between such scheduled cleanings, however, the efficiency of the heat exchanger may deteriorate significantly. As a result, the heat exchanger may operate inefficiently for a significant period of time before the heat exchanger is cleaned, thereby resulting in a waste of energy and an increase in operating cost. Accordingly, it is desirable to monitor the efficiency of the heat exchanger during its operation.

Conventional systems and methods for monitoring the efficiency of heat exchangers require special fouling sensors and/or specific information about the construction of the heat exchangers. Examples of such conventional heat exchanger monitoring systems and methods are disclosed in U.S. Pat. No. 5,992,505 to Moon, U.S. Pat. No. 5,615,733 to Yang and U.S. Pat. No. 4,766,553 to Kaya et al. In all of these patents, the efficiency of a heat exchanger is determined from a ratio between the heat transfer coefficient at a baseline time period and the heat transfer coefficient at a measured time period, wherein the heat transfer coefficients are calculated using, inter alia, the area and thickness of the heat transfer surface(s). The Moon patent further requires a special fouling sensor having a metal wire wound in a spiral around a body having heating wires extending therethrough. Thus, conventional heat exchanger monitoring systems and methods must be specially customized for the heat exchangers to which they are applied and often require special equipment, such as fouling sensors, to be mounted on or near the heat exchanger.

Based on the foregoing, there exists a need in the art for a system and method for monitoring the performance of a heat exchanger, wherein the system and method do not require specific information about the heat exchanger and do not require special fouling sensors to be mounted on or adjacent to the heat exchanger. The present invention is directed to such a system and method.

SUMMARY OF THE INVENTION

In accordance with the present invention, a system and method are provided for monitoring the performance of a heat exchanger having hot and cold legs through which hot and cold fluids flow, respectively. The hot leg has a hot inlet and a hot outlet, while the cold leg has a cold inlet and a cold outlet. The system includes a plurality of field devices connected to the heat exchanger, a computer connected to a communication link and a software program operable to perform steps of the method. Operating values of the heat exchanger are measured by the field devices. The operating values include the temperature of the hot fluid at the hot inlet ($T^{HOT\text{-}IN}$), the temperature of the hot fluid at the hot outlet ($T^{HOT\text{-}OUT}$), the temperature of the cold fluid at the cold inlet ($T^{COLD\text{-}IN}$) and the temperature of the cold fluid at the cold outlet ($T^{COLD\text{-}OUT}$). A training operation is performed, wherein baseline values of a performance factor (E) are calculated for baseline sets of the operating values, respectively. These baseline values of E and the baseline sets of the operating values they correspond to are stored. After the training operation, a current set of the operating values is received and a current value of E for the current set of the operating values is calculated. A baseline value of E for a baseline set of the operating values is then retrieved, wherein the baseline set of the operating values at least substantially matches the current set of the operating values. The current value of E is compared to the retrieved baseline value of E to obtain a measure of any change in performance of the heat exchanger. E provides a measure of the performance of the heat exchanger and is calculated using $T^{HOT\text{-}IN}$, $T^{HOT\text{-}OUT}$, $T^{COLD\text{-}IN}$ and $T^{COLD\text{-}OUT}$ and without using any information concerning the physical construction of the heat exchanger. E is calculated using one of the following equations, depending on the phases of the hot and cold fluids:

$$E=(\Delta T^{HOT}\times\Delta T^{COLD})\div(\Delta T^{X})^2; \quad \text{(i.)}$$

$$E=(\Delta T^{HOT\text{-}EFF}\times\Delta T^{COLD})\div(\Delta T^{X\text{-}H\text{-}EFF})^2; \quad \text{(ii.)}$$

$$E=(\Delta T^{HOT}\times\Delta T^{COLD\text{-}EFF})\div(\Delta T^{X\text{-}C\text{-}EFF};^2 \text{ and} \quad \text{(iii.)}$$

$$E=(\Delta T^{HOT\text{-}EFF}\times\Delta T^{COLD\text{-}EFF})\div(\Delta T^{X\text{-}HC\text{-}EFF})^2; \quad \text{(iv.)}$$

wherein equation (i.) is used when both fluids are single phase; equation (ii.) is used when the hot fluid is two-phase (condensing); equation (iii.) is used when the cold fluid is two-phase evaporating; and equation (iv.) is used when the hot fluid is two-phase (condensing) and the cold fluid is two-phase (evaporating).

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
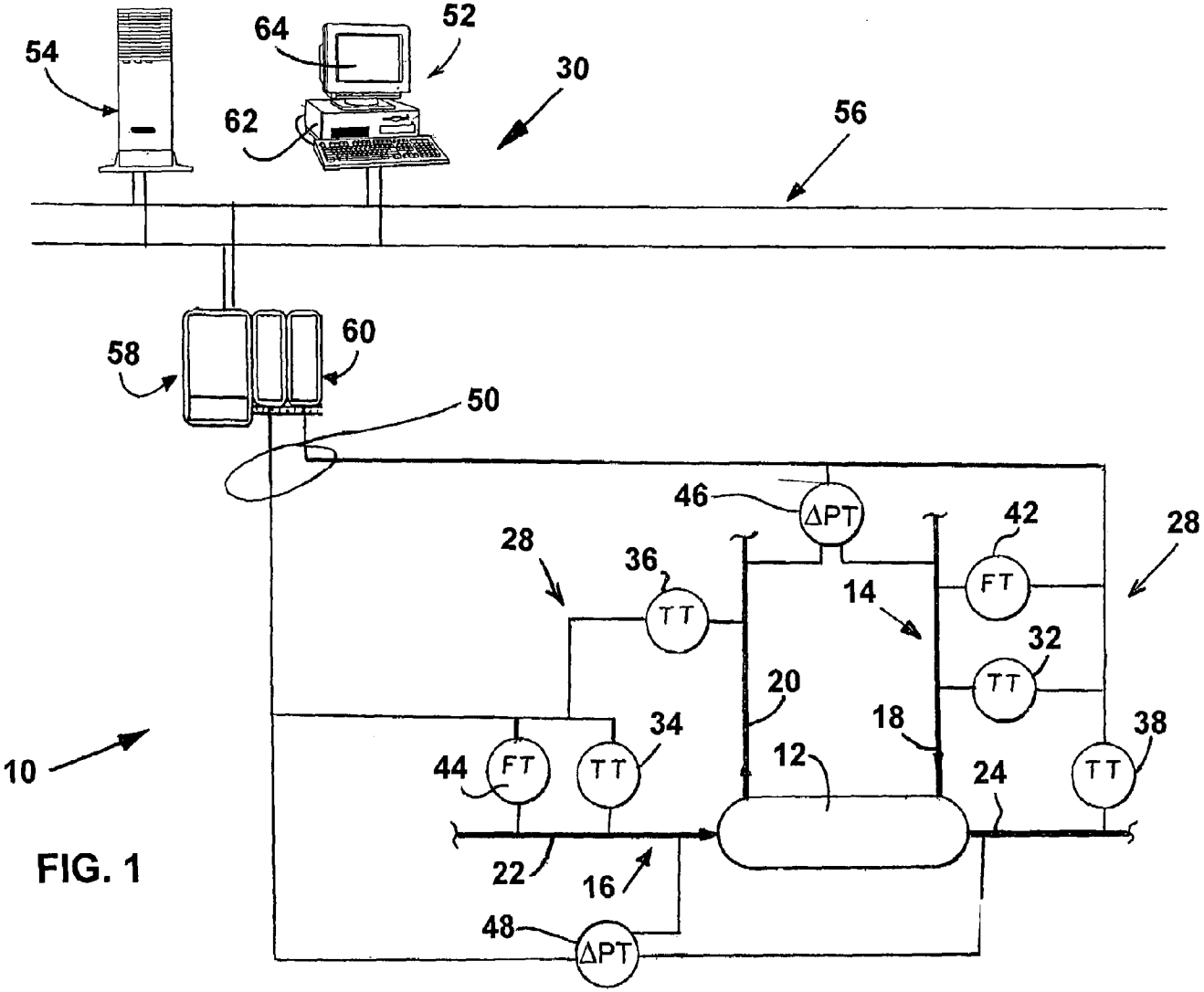
FIG. 1 is a schematic view of a monitoring system for assessing changes in the performance of a heat exchanger.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein, the acronym "OPC" shall mean object linking and embedding for process control.

As used herein, the acronym "DCOM" shall mean distributed component object model.

In the following description, all measurement values are expressed in units of the Système International d'Unités (International System of Units). Accordingly, temperature values (such as $T^{HOT-IN}$ and $T^{COLD-IN}$) are expressed in units kelvin; specific heat values (such $C^{HOT}$ and $C^{COLD}$) are expressed in units joules per kilogram kelvin; mass flow rate values are expressed in units kilogram per second; and pressure values are expressed in units pascal.

Referring now to FIG. 1, there is shown a monitoring system 10 embodied in accordance with the present invention. The monitoring system 10 is operable to assess changes in the performance of a recuperative heat exchanger 12 having a hot leg 14 and a cold leg 16. The hot leg 14 includes a hot inlet 18 connected to a hot outlet 20 by a hot flow path (not shown) extending through the heat exchanger 12, while the cold leg 16 includes a cold inlet 22 connected to a cold outlet 24 by a cold flow path (not shown) extending through the heat exchanger 12. The hot flow path and the cold flow path are separated by structures, such as tube walls or plates. In this regard, the heat exchanger 12 can have a shell and tube construction, a plate construction, a spiral construction or any other type of construction that separates the hot and cold flow paths. In addition, the process fluid and the thermal transfer fluid can be single phase or two phase and can be parallel flow, counter flow or cross flow. In essence, the heat exchanger 12 can be any type of recuperative heat exchanger.

The heat exchanger 12 is a component of a process, such as a cooling system of a power plant. The heat exchanger 12 is connected between other portions of the process to receive and discharge a process fluid, such as water, and a thermal transfer fluid, which may also be water. The process fluid and the thermal transfer fluid are at different temperatures. The heat exchanger 12 can be used to cool the process fluid or to heat the process fluid. In the former case, the process fluid flows through the hot leg 14, while the cooler thermal transfer fluid flows through the cold leg 16. In the later case, the process fluid flows through the cold leg 16, while the warmer thermal transfer fluid flows through the hot leg 14.

The monitoring system 10 generally includes a plurality of field devices 28 and a process automation system 30. The field devices 28 include a hot inlet temperature transmitter 32, a cold inlet temperature transmitter 34, a hot outlet temperature transmitter 36 and a cold outlet temperature transmitter 38. Preferably, the field devices 28 also include a hot leg mass flowmeter 42, a cold leg mass flowmeter 44, a hot leg differential pressure transmitter 46 and a cold leg differential pressure transmitter 48.

The hot inlet temperature transmitter 32 is connected to a temperature sensor (not shown) disposed in the hot inlet 18 for measuring the temperature of the fluid flowing therethrough ($T^{HOT-IN}$), while the cold inlet temperature transmitter 34 is connected to a temperature sensor (not shown) disposed in the cold inlet 22 for measuring the temperature of the fluid flowing therethrough ($T^{COLD-IN}$). The hot outlet temperature transmitter 36 is connected to a temperature sensor (not shown) disposed in the hot outlet 20 for measuring the temperature of the fluid flowing therethrough ($T^{HOT-OUT}$), while the cold outlet temperature transmitter 38 is connected to a temperature sensor (not shown) disposed in the cold outlet 24 for measuring the temperature of the fluid flowing therethrough ($T^{COLD-OUT}$). The hot and cold inlet temperature transmitters 32, 34 and the hot and cold outlet temperature transmitters 36, 38 respectively communicate the values of $T^{HOT-IN}$, $T^{COLD-IN}$, $T^{HOT-OUT}$ and $T^{COLD-OUT}$ to the process automation system 30 over a field network 50, which may utilize shielded twisted pair wires, coaxial cables, fiber optic cables, or wireless communication channels.

The hot leg mass flowmeter 42 is connected into the hot inlet 18 for measuring the mass flow rate of the fluid flowing through the hot leg 14 ($W^{HOT}$), while the cold leg mass flowmeter 44 is connected into the cold inlet 22 for measuring the mass flow rate of the fluid flowing through the cold leg 16 ($W^{COLD}$). The hot leg mass flow meter 42 and the cold leg mass flow meter 44 may each be a coriolis-type mass flow meter. The hot leg differential pressure transmitter 46 is connected through piping to both the hot inlet 18 and the hot outlet 20 to measure the differential pressure between the hot inlet 18 and the hot outlet 20 ($DeltaP^{HOT}$). The cold leg differential pressure transmitter 48 is connected through piping to both the cold inlet 22 and the cold outlet 24 to measure the differential pressure between the cold inlet 22 and the cold outlet 24 ($DeltaP^{COLD}$). The hot leg and cold leg mass flow meters 42, 44 and the hot leg and cold leg differential pressure transmitters 46, 48 respectively communicate the values for $W^{HOT}$, $W^{HOT}$, $DeltaP^{HOT}$ and $DeltaP^{COLD}$ to the process automation system 30 over the field network 50.

It should be appreciated that in lieu of the hot leg differential pressure transmitter 46, a pair of absolute pressure transmitters may be provided for the hot inlet 18 and the hot outlet 20, respectively, and that in lieu of the cold leg differential pressure transmitter 48, a pair of absolute pressure transmitters may be provided for the cold inlet 22 and the cold outlet 24 respectively, wherein the process automation system 30 obtains $DeltaP^{HOT}$ and $DeltaP^{COLD}$ from the differences between the signals from each pair of transmitters. It should also be appreciated that the hot and cold leg mass flowmeters 42, 44 may be eliminated and that $W^{HOT}$ and $W^{COLD}$ may be calculated by the process automation system 30 using volumetric flows and the densities of the fluids.

The process automation system 30 is preferably a distributed control system, such as a System 800x A distributed control system, which is commercially available from the assignee of the present invention, ABB Inc. The process automation system 30 generally includes at least one work station 52, system servers 54, a control network 56 and typically one or more controllers 58. Input signals from the field devices 28 are communicated over the field network 50 to the control network 56 by 4–20 mA signaling and/or by one or more of the conventional control protocols, such as the HART® protocol, the Foundation™ Fieldbus protocol, or the Profibus protocol. For any of the field devices 28 communicating via the Foundation™ Fieldbus protocol, the field network 50 comprises HSE/H1 linking devices, which connect the field devices 28 to a high speed Ethernet subnet, which is connected to the control network 56 through an FF HSE communication interface of the controller 58 and/or an FF OPC server. For any field devices 28 communicating via the Profibus protocol, the field network 50 comprises DP/PA linking devices, which connect the field devices 28 to a Profibus-DP line, which is connected to the control network 56 through a Profibus communication interface of the controller 58. For any field devices 28 communicating via 4–20 mA signaling and/or the HART® protocol, the field network 50 typically comprises shielded twisted pair wires, which connect the field devices 28 to an I/O subsystem 60, which includes one or more I/O modules with one or more associated module termination units, as is shown in FIG. 1. The I/O subsystem 60 is connected by a module bus to the controller 58, which is connected to the control network 56.

The work station 52 is a personal computer (PC) with a central processing unit (CPU) 62 and a monitor 64 for providing visual displays to an operator. A human system interface (HSI) 66 runs on the CPU 62 of the work station 52. The HSI 66 has a client/server architecture and communication based on OPC. The HSI 66 includes an object browser and preferably a navigator, which is a multi-frame document rendered inside the browser. The HSI 66 also preferably includes a configuration server, function block server, a historian, a report system, a trending system and an alarm and event system. A suitable human system interface that may be utilized for the HSI 66 is Process Portal™, which is commercially available from the assignee of the present invention, ABB Inc. Process Portal™ is based on Microsoft Windows 2000 and has an object browser, Plant Explorer, that is based on Microsoft Explorer.

The system servers 54 include an OPC server 68, application servers and aspect servers. The system servers 54 can be hosted on the CPU 62 of the work station 52 or on one or more separate CPUs, as shown in FIG. 1. In addition, the system servers 54 can be single or redundant, i.e., running on more than one PC.

The OPC server 68 is a standardized interface based on Microsoft's OLE (now Active X), COM, and DCOM technologies. The OPC server 68 makes information from the controller 58, the field devices 28 and other portions of the process automation system 30 available to any OPC client connected to the control network 56, such as the HSI 66.

The aspect servers implement a method of organizing information (or aspects) about real word objects (such as the field devices) in the process automation system, wherein the aspects (and functional applications associated with the aspects) are linked or associated with the objects. More information about this aspect object methodology is set forth in U.S. Pat. No. 6,694,513 to Andersson et al., which is assigned to a sister company of the assignee of the present invention and is hereby incorporated by reference.

The application servers include an asset optimization (AO) application 70 having a heat exchanger asset monitor (HXAM) 72 embodied in accordance with the present invention, both of which will be more fully described below. The application servers may further include a batch management application, an information management application and/or a simulation and optimization application.

The control network 56 interconnects the work station 5, the controller 58 and the system servers 54. The control network 56 includes a pair of redundant Ethernet cables over which information is communicated using the Manufacturing Message Specification (MMS) communication protocol and a reduced OSI stack with the TCP/IP protocol in the transport/network layer. Together, the control network 56 and the field network 50 help form a communication link over which information may be transmitted between the field devices 28 and clients, such as the HXAM 72 and the HSI 66.

Figure 2:
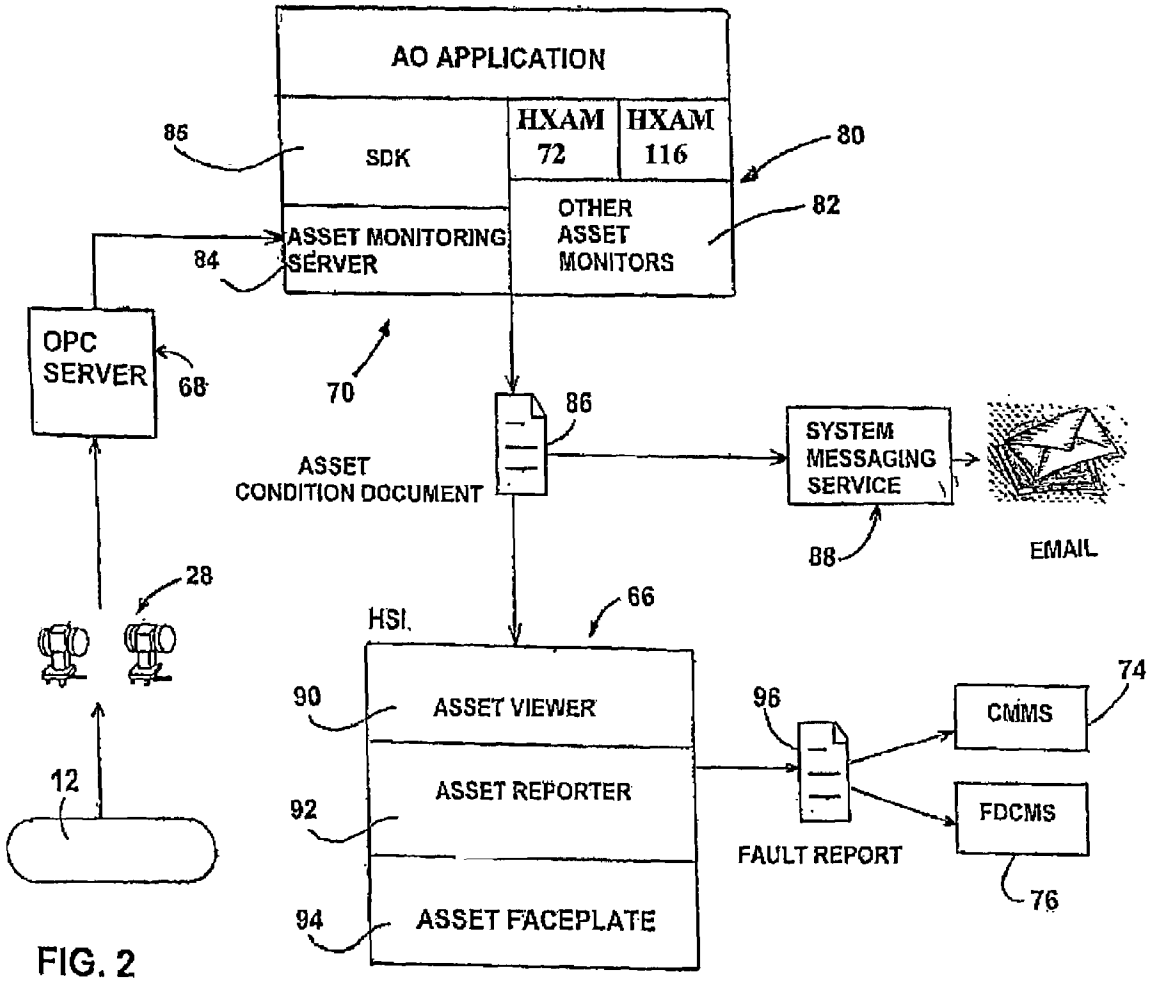
FIG. 2 is a diagram showing the flow of information through the monitoring system.

With reference now to FIG. 2, the AO application 70 integrates asset monitoring and decision support applications with the HSI 66, as well as a computerized maintenance management system (CMMS) 74 and typically a field device calibration and management system (FDCMS) 76. A strategic asset management software package sold under the tradename MAXIMO® by MRO Software, Inc. has been found suitable for use as the CMMS 74, while a device management software package sold under the tradename DMS by Merriam Process Technologies has been found suitable for use as the FDCMS 76. The AO application 70 includes a library of standard asset monitors 80, including the HXAM 72 and other asset monitors 82, which may monitor other physical components of the process and/or field devices and information technology assets of the process automation system 30. In addition, the AO application 70 includes an asset monitoring server 84 and a software development kit (SDK) 85 based on Visual Basic® from Microsoft Corporation, which can be used to create custom asset monitors. Preferably, the AO application 70 has an architecture substantially in accordance with the AO architecture described in U.S. patent application Ser. No. 09/956,578 (Publication Number US2003/0056004A1), which is assigned to the assignee of the present invention and is hereby incorporated by reference.

The asset monitors 80 can be configured to perform Boolean checks, quality checks, runtime accumulation checks, high, low, high/low limit checks, XY profile deviation checks and flow delta checks. The parameters of the asset monitors 80, such as conditions and subconditions, are defined using Excel™, which is a spreadsheet program from Microsoft Corporation. A condition of an asset monitor 80 can be a variable (such as $T^{HOT\text{-}IN}$) of an asset being monitored (such as the heat exchanger), while the subcondition can be the status or quality of the condition, such as "normal" or "too high". An asset monitor 80 can be configured such that if a subcondition is met (such as "too high"), the asset monitor 80 creates an asset condition document 86, which is an XML file containing all information necessary to describe an asset condition. The asset condition document 86 is transmitted to the HSI 66 and may also be reformatted and sent to a system messaging service 88 for delivery to plant operating personnel via email and/or pager. The system messaging service 88 permits plant operating personnel to subscribe to a plurality of asset monitors 80 for which the plant operating personnel desire to receive status change information.

Once an asset monitor 80 is created, an object for the asset monitor 80 is created in the HSI 66 using the asset monitoring server 84. Preferably, an asset viewer 90, an asset reporter 92 and an asset faceplate 94 are added as aspects to the object created in the HSI 66 for the asset monitor 80. An asset tree is visible in the asset viewer 90. The asset tree shows the status of assets based on the hierarchies of the browser. The status of the asset is displayed adjacent to the asset through the use of an icon. The asset reporter 92 provides a summary of the status of the conditions and subconditions for the asset monitor 80, while the asset faceplate 94 displays detailed information about the performance of the asset and the operating variables of the asset. The asset viewer 90 and the asset reporter 92 can be shown in a single view displayed on the monitor 64 of the work station 52. When the HSI 66 receives an asset condition document 86 that indicates a problem, the HSI 66 generates an asset alarm, which is displayed in the asset tree through the use of an icon, which is selected based on the severity of the alarm. Each icon represents the composite severity of an object and all children beneath the object. The alarm is also shown in the asset reporter 92 through the use of a color, which is also selected based on the severity of the alarm. The severity of the alarm is determined using an asset monitor severity range of 1 to 1000. By right-clicking on the alarm either in the asset viewer 90 or the asset reporter 92, a context menu pops up, which permits a fault report 96 to be submitted to the CMMS 74 and the FDCMS 76.

The HXAM 72 is written in Visual Basic® using the SDK 85 and its parameters are defined using Excel. An object for the HXAM 72 is created in the HSI 66 and is provided with aspects, including the asset viewer 90, the asset reporter 92 and the asset faceplate 94. The values E (defined below), $\Delta T^{X}$ (defined below), $T^{HOT\text{-}IN}$, $T^{COLD\text{-}IN}$, $W^{HOT}$, $W^{COLD}$, $DeltaP^{HOT}$ and $DeltaP^{COLD}$ are set as the conditions, each having the subconditions of "normal", "increasing", "decreasing", "too high" and "too low". The condition "E" further has the subcondition "Cannot Calculate Comparisons". Preferably, the values $HD^{HOT}$ (defined below), $HD^{COLD}$ (defined below), and AHD (defined below) are also set as conditions, each having the subconditions of "normal", "too high" and "too low".

The HXAM 72 interacts with the system servers 54 to receive data from the field devices 28, which the HXAM 72 then manipulates, monitors and evaluates. More specifically, the HXAM 72 subscribes to the OPC server 68 to receive $T^{HOT\text{-}IN}$, $T^{COLD\text{-}IN}$, $T^{HOT\text{-}OUT}$ and $T^{COLD\text{-}OUT}$, $W^{HOT}$, $W^{COLD}$, $DeltaP^{HOT}$ and $DeltaP^{COLD}$ (collectively, the "HX values") therefrom and utilizes the HX values to monitor and evaluate the performance of the heat exchanger 12. In monitoring and evaluating the heat exchanger 12, the HXAM 72 does not rely upon any specific knowledge of the design or physical structure of the heat exchanger 12, such as the area or thickness of the heat transfer surface. Rather, the HXAM 72 relies solely on differential temperature (ΔT) measurements made across the heat exchanger 12 (for particular operating conditions of the heat exchanger 12) to monitor and evaluate the performance of the heat exchanger 12. The ΔT measurements are used to calculate a value called "efficacy" or "performance factor" (and designated by the initial E), which should not be confused with "efficiency" or "effectiveness", which have established meanings in the industry. If the heat exchanger 12 is single phase for both the hot and cold fluids (i.e., is not a hot-side condensing heat exchanger or a cold-side evaporating heat exchanger), the performance factor, E, of the heat exchanger 12 is calculated as follows:

$$E = \frac{(\Delta T^{HOT} \times \Delta T^{COLD})}{(\Delta T^{X})^2} \tag{1}$$

where, $$\Delta T^{HOT} = T^{HOT\text{-}IN} - T^{HOT\text{-}OUT}$$

$$\Delta T^{COLD} = T^{COLD\text{-}OUT} - T^{COLD\text{-}IN}$$

$$\Delta T^{X} = T^{HOT\text{-}IN} - T^{COLD\text{-}IN}$$

If the heat exchanger 12 is two-phase only for the hot fluid, with the hot fluid condensing, then the performance factor, E, is calculated as follows:

$$E = \frac{(\Delta T^{HOT-EFF} \times \Delta T^{COLD})}{(\Delta T^{X-H-EFF})^2} \tag{2}$$

where, $$T^{HOT\text{-}VAP\text{-}CORR} = C^{HOT\text{-}VAP} \div C^{HOT}$$

$$\Delta T^{HOT\text{-}EFF} = \Delta T^{HOT} + T^{HOT\text{-}VAP\text{-}CORR}$$

$$\Delta T^{X\text{-}H\text{-}EFF} = (T^{HOT\text{-}IN} + T^{HOT\text{-}VAP\text{-}CORR}) - T^{COLD\text{-}IN}$$

$C^{HOT}$ is the specific heat of the hot-side fluid $C^{HOT\text{-}VAP}$ is the heat of vaporization for the hot-side fluid If the heat exchanger 12 is two-phase only for the cold fluid, with the cold fluid evaporating, then the performance factor, E, is calculated as follows:

$$E = \frac{(\Delta T^{HOT} \times \Delta T^{COLD-EFF})}{(\Delta T^{X-C-EFF})^2} \tag{3}$$

where, $$T^{COLD\text{-}VAP\text{-}CORR} = C^{COLD\text{-}VAP} \div C^{COLD}$$

$$\Delta T^{COLD\text{-}EFF} = \Delta T^{COLD} + T^{COLD\text{-}VAP\text{-}CORR}$$

$$\Delta T^{X\text{-}C\text{-}EFF} = T^{HOT\text{-}IN} - T^{COLD\text{-}IN} + T^{COLD\text{-}VAP\text{-}CORR}$$

$C^{COLD}$ is the specific heat of the cold-side fluid $C^{COLD\text{-}VAP}$ is the heat of vaporization for the cold-side fluid If the heat exchanger 12 is two-phase for both the hot fluid and the cold fluid, with the hot fluid condensing and the cold fluid evaporating, then the performance factor, E, is calculated as follows:

$$E = \frac{(\Delta T^{HOT-EFF} \times \Delta T^{COLD-EFF})}{(\Delta T^{X-HC-EFF})^2} \tag{4}$$

where, $$\Delta T^{X\text{-}HC\text{-}EFF} = T^{HOT\text{-}IN} + T^{HOT\text{-}VAP\text{-}CORR} - T^{COLD\text{-}IN} + T^{COLD\text{-}VAP\text{-}CORR}$$

If the heat exchanger 12 is single-phase for both the hot and cold fluids, then the heat duty for the hot fluid, ($HD^{HOT}$) and the heat duty for the cold fluid ($HD^{COLD}$) are calculated as set forth below:

$$HD^{HOT}=W^{HOT}\times C^{HOT}\times\Delta T^{HOT} \quad (5)$$

$$HD^{COLD}=W^{COLD}\times C^{COLD}\times\Delta T^{COLD} \quad (6)$$

If the heat exchanger 12 is two-phase for the hot fluid, with the hot fluid condensing, then $HD^{COLD}$ is calculated pursuant to equation (6) above and $HD^{HOT}$ is calculated as set forth below:

$$HD^{HOT}=W^{HOT}\times C^{HOT}\times\Delta T^{HOT}+(W^{HOT}\times C^{HOT\text{-}VAP}) \quad (7)$$

If the heat exchanger 12 is two-phase for the cold fluid, with the cold fluid evaporating, then $HD^{HOT}$ is calculated pursuant to equation (5) above and $HD^{COLD}$ is calculated as set forth below:

$$HD^{COLD}=W^{COLD}\times C^{COLD}\times\Delta T^{COLD}\times(W^{COLD}\times C^{COLD\text{-}VAP}) \quad (8)$$

The difference between $HD^{HOT}$ and $HD^{COLD}$($\Delta HD$) is:

$$\Delta HD=HD^{HOT}-HD^{COLD} \quad (9)$$

The HXAM 72 monitors changes in E to evaluate the performance of the heat exchanger 12. More specifically, the HXAM 72 periodically samples the HX values and uses them to calculate a value of E ($E^{NEW}$), which is then used to calculate a percentage change in value of E ($\Delta E$) from a baseline value ($E^{BASELINE}$), as follows:

$$\Delta E(\%) = 100\times\frac{(E^{NEW}-E^{BASELINE})}{E^{BASELINE}} \quad (10)$$

The $E^{BASELINE}$ value that is used to calculate $\Delta E(\%)$ is selected from a collection or library of $E^{BASELINE}$ values that have been calculated for different operating conditions of the heat exchanger 12. The library of $E^{BASELINE}$ values are calculated during an initial training operation that is conducted when the heat exchanger 12 is initially associated with the HXAM 72. The library of $E^{BASELINE}$ values may be cleared and repopulated with newly calculated $E^{BASELINE}$ values during subsequent training operations, which may be conducted after cleanings or rebuilds of the heat exchanger 12, respectively. The training operation lasts for a period of time that is preferably the smaller of 200 hours or 1/100 of the normal service interval (NSI) of the heat exchanger (i.e., the time interval between cleanings of the heat exchanger). During the training operation, HX values are received from the OPC server 68 and read, a full set of such HX values hereinafter being referred to as a baseline operating point set ("BOPS"). An $E^{BASELINE}$ value is calculated for each significantly different operating condition of the heat exchanger 12, i.e., for each significantly different BOPS. For this purpose, the heat exchanger 12 is determined to be at a significantly different operating condition if any of the BOPS values changes by a threshold percentage, which is set by an operator prior to the training operation. The threshold percentage is selected by the operator based on a review of historical operating data from the heat exchanger 12. Typically, changes in the operating data from the heat exchanger 12 are concentrated within a percentage band, such as ±5%, with occasional spikes outside of this band. When reviewing the historical operating data, the operator identifies the band and sets the threshold percentage to the band.

In accordance with the foregoing, during the training period, BOPS are received from the OPC server 68 and read. For a given BOPS, an $E^{BASELINE}$ value is calculated using, as applicable, equation (1), equation (2), equation (3), or equation (4) and when any one of the BOPS changes by the threshold percentage or more, a new BOPS is determined to exist and a new $E^{BASELINE}$ value is calculated for the new BOPS. All of the calculated $E^{BASELINE}$ values are related to, or associated with, the BOPS values for which they were calculated and are stored in the library, together with their associated BOPS. Thus, the library (which is located in a text file) typically contains a plurality of different $E^{BASELINE}$ values that are associated with a plurality of different BOPS values, respectively.

After the training operation is completed, the HXAM 72 enters an operating period, wherein the HXAM 72 receives sets of current HX values in accordance with a sample interval, which is preferably the greater of once every 60 seconds, or approximately once every 1/5000 of the NSI of the heat exchanger. For each retrieved set of current HX values, the HXAM 72 calculates $E^{NEW}$ from the temperature values thereof (i.e., $T^{HOT\text{-}IN}$, $T^{COLD\text{-}IN}$, $T^{HOT\text{-}OUT}$ and $T^{COLD\text{-}OUT}$) using, as applicable, equation (1), equation (2), equation (3) or equation (4) above. In addition, the HXAM 72 searches the library for a BOPS that at least substantially matches the set of current HX values. For this purpose, a BOPS is deemed to at least substantially match a current set of HX values if a comparison of the BOPS to the current set of HX values meets or exceeds an evaluation criteria, which may be set by an operator. One example of an evaluation criteria that may be used looks at the differences in each of the $T^{HOT\text{-}OUT}$, $T^{COLD\text{-}OUT}$, $W^{HOT}$, $W^{COLD}$, $\Delta T^{HOT}$, $\Delta T^{COLD}$ values between the BOPS and the current HX values and assigns a weighted number to the difference if the difference is less than a certain percentage, such as one percent (1%), and assigns a zero to the difference if the difference is greater than the certain percentage. The numbers (if any) for all the values are then added up and if the sum meets or exceeds a threshold sum, the evaluation criteria is determined to be met or exceeded. It has been found that weighted numbers of 5, 5, 4, 4, 3, 3, for $T^{HOT\text{-}OUT}$, $T^{COLD\text{-}OUT}$, $W^{HOT}$, $W^{COLD}$, $\Delta T^{HOT}$, $\Delta T^{COLD}$, respectively and a threshold sum of 14 produce satisfactory results.

It should be appreciated that the present invention is not limited to the foregoing evaluation criteria for determining whether a BOPS at least substantially matches the set of current HX values. Other evaluation criteria may be used without departing from the scope of the present invention.

When the HXAM 72 finds a substantially matching BOPS, the HXAM 72 calculates $\Delta E(\%)$ from the calculated $E^{NEW}$ and the $E^{BASELINE}$ for the substantially matching BOPS, using equation (10) above. The calculated $\Delta E(\%)$ is provided to the HSI 66, which displays its value in the asset faceplate 94. The calculated $\Delta E(\%)$ provides a measure of the change in performance of the heat exchanger 12. If the calculated $\Delta E(\%)$ is positive, zero, or negative by less than a first percentage amount (such as 2%) the HXAM 72 does not issue an asset condition document 86. If, however, the calculated $\Delta E(\%)$ is negative by more than the first percentage amount, the HXAM 72 transmits an asset condition document 86 to the HSI 66, notifying the HSI 66 that the performance factor of the heat exchanger 12 has declined. In response, the HSI 66 generates an alarm which is indicated in the asset viewer 90 by an icon (such as a flag) and in the asset reporter 92 by a color (such as yellow), indicating a medium severity. If the calculated $\Delta E(\%)$ is negative by a second percentage amount (such as 5%) or more, the HXAM 72 transmits an asset condition document 86 to the HSI 66, notifying the HSI 66 that the performance factor of the heat exchanger 12 has declined significantly. In response, the HSI 66 generates an alarm which is indicated in the asset viewer 90 by an icon (such as a red circle with a cross) and in the asset reporter 92 by a color (such as red), indicating maximum severity. Upon viewing such an alarm, an operator will typically generate a fault report 96, which is transmitted to the CMMS 74 and the FDCMS 76.

If instead of being negative, the calculated ΔE(%) is positive and by a third percentage amount (such as 2%) or more, the HXAM 72 transmits an asset condition document 86 to the HSI 66, notifying the HSI 66 that the performance factor of the heat exchanger 12 has improved. If the calculated ΔE(%) is positive by a fourth percentage amount (such as 5%) or more, the HXAM 72 transmits an asset condition document 86 to the HSI 66, notifying the HSI 66 that the performance factor of the heat exchanger 12 has significantly improved. Moreover, if the calculated ΔE(%) is positive by the fourth percentage amount (or more) for more than three sample intervals, with $E^{BASELINE}$ and $E^{NEW}$ remaining the same, then $E^{BASELINE}$ and its associated BOPS are replaced by the $E^{NEW}$ and its associated set of current HX values, i.e., the $E^{NEW}$ and its associated set of current HX values become an $E^{BASELINE}$ and an associated BOPS.

The foregoing first, second, third and fourth percentage levels for determining whether the performance factor of the heat exchanger 12 is declining or improving are selected by an operator based upon the operating characteristics of the heat exchanger 12. If, during the normal operation of the HXAM 72, the HXAM 72 is unable to find a BOPS that at least substantially matches the current set of HX values, the HXAM 72 transmits an asset condition document 86 to the HSI 66, indicating that the HXAM 72 is unable to find a matching BOPS. In response, the HSI 66 generates an alarm which is indicated in the asset viewer 90 by an icon (such as an "i" in a bubble) and in the asset reporter 92 by a color (such as white), indicating that a comparison cannot be made.

If, during the operating period, a particular BOPS stored in the library is not detected again for a particular period of time (i.e., a staleness period), then the BOPS is deleted from the library. If, during the operating period, all of the stored BOPS go undetected for the staleness period, then the HXAM 72 issues an asset condition document 86 to the HSI 66, informing the HSI 66 that the entire library of BOPS and associated $E^{BASELINE}$ values has gone stale. The HXAM 72 may be configured to automatically initiate a new training period if one or more BOPS in the library goes stale, or a new training period my be initiated manually by an operator through a pushbutton 114 on the asset faceplate 94.

Figure 3:
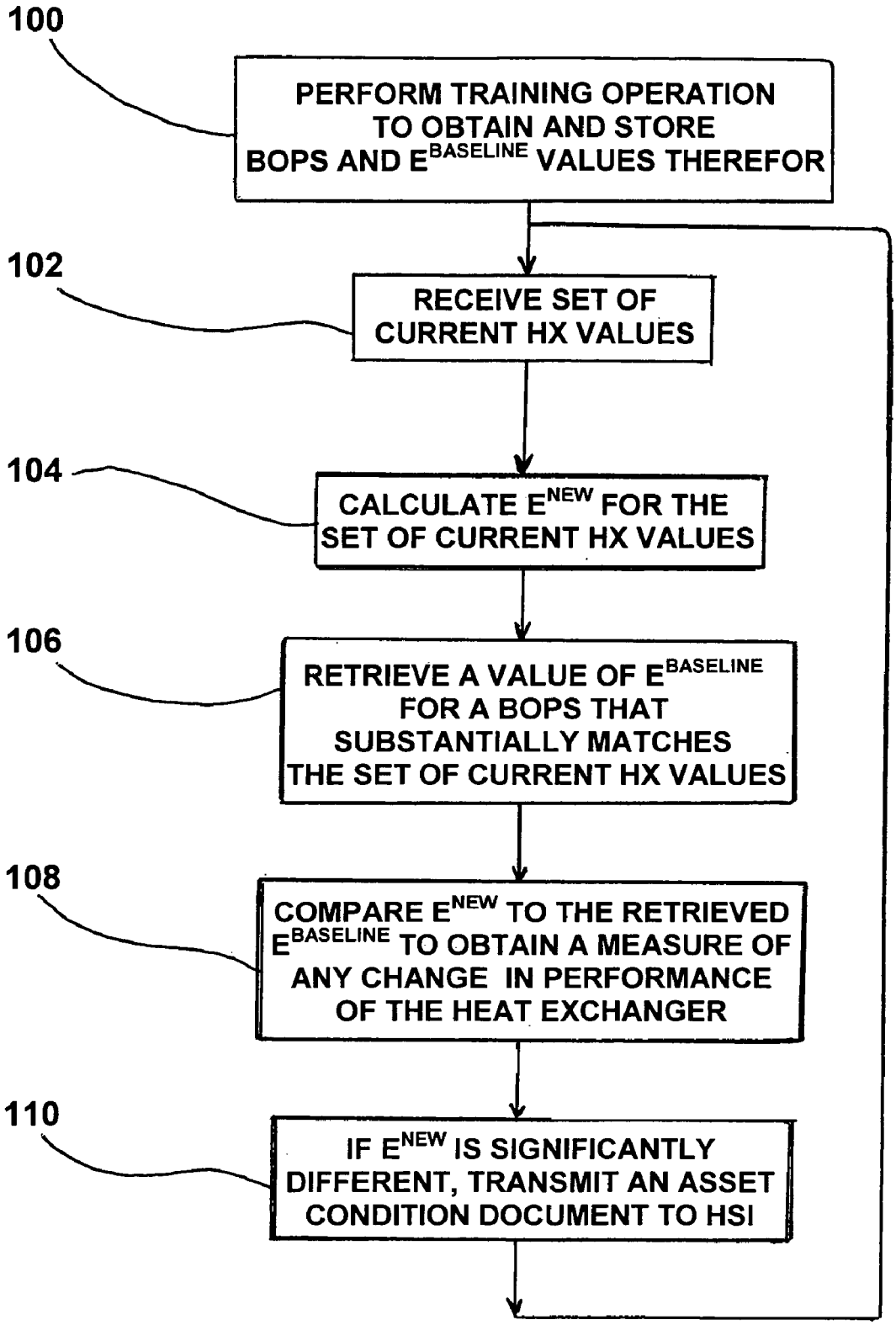
FIG. 3 is a flow diagram of a method of assessing changes in the performance of the heat exchanger.

With reference now to FIG. 3, the foregoing operation of the HXAM 72 can be summarized as follows. In an initial step 100, the HXAM 72 performs the training operation to obtain and store BOPS and $E^{BASELINE}$ values therefor. After the completion of the training operation, the HXAM 72 proceeds to step 102, wherein the HXAM 72 receives sets of current HX values from the OPC server 68. After step 102, the HXAM 72 proceeds to step 104, wherein the HXAM 72 calculates $E^{NEW}$ for the set of current HX values. In a subsequent step 106, the HXAM 72 retrieves a value of $E^{BASELINE}$ for a BOPS that at least substantially matches the current set of current HX values. After step 106, the HXAM 72 proceeds to step 108, wherein the HXAM 72 compares $E^{NEW}$ to the retrieved $E^{BASELINE}$ using equation (10) above. If ΔE(%) calculated in step 108 is negative by more than the first percentage level or is positive by more than the third percentage level, the HXAM 72 transmits an asset condition document to the HSI 66 in step 110. After step 110, the HXAM 72 returns to step 102.

Figure 4:
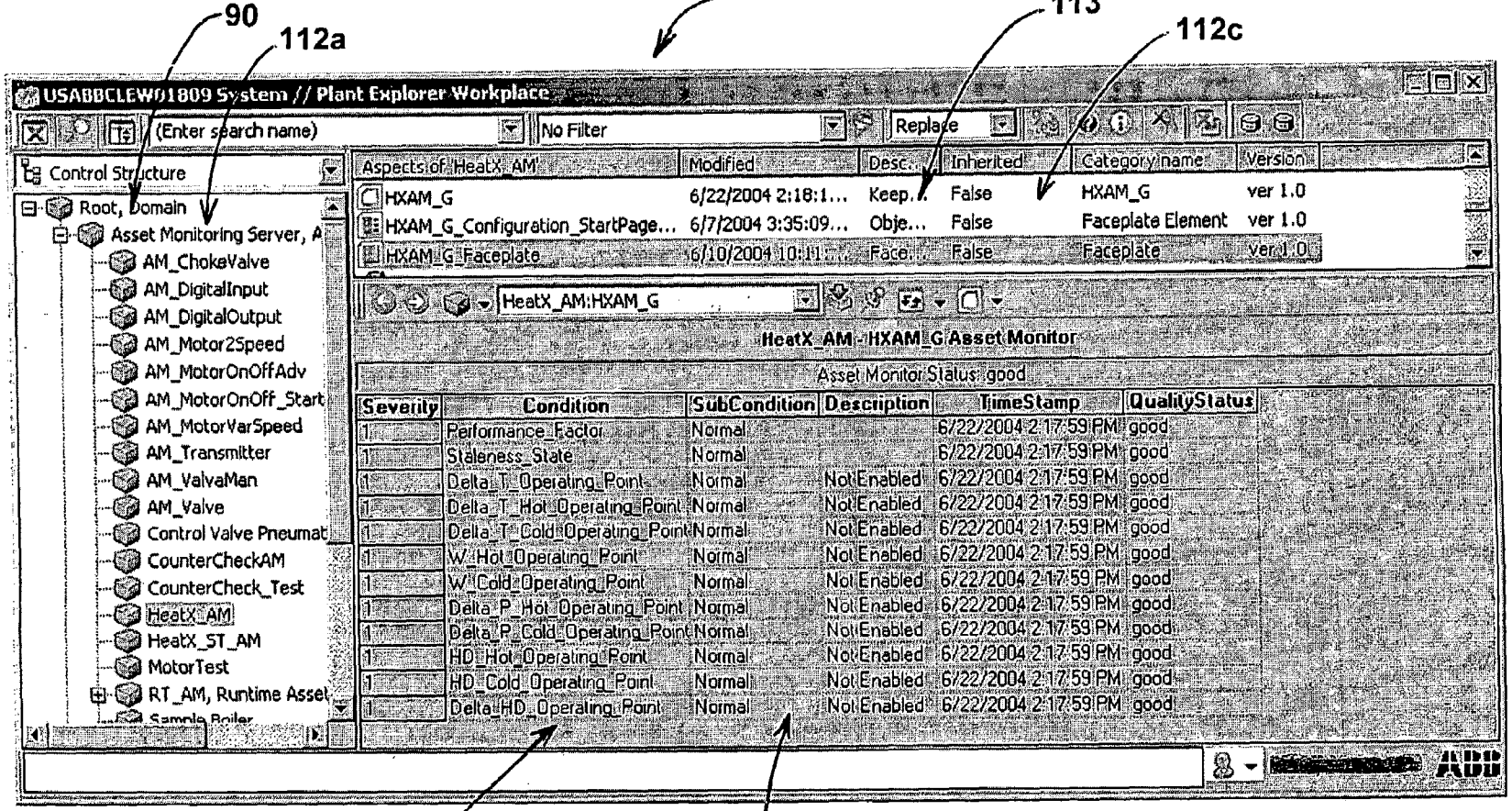
FIG. 4 is a view of a screen on a computer monitor of the monitoring system showing an asset viewer and an asset recorder.
Figure 5:
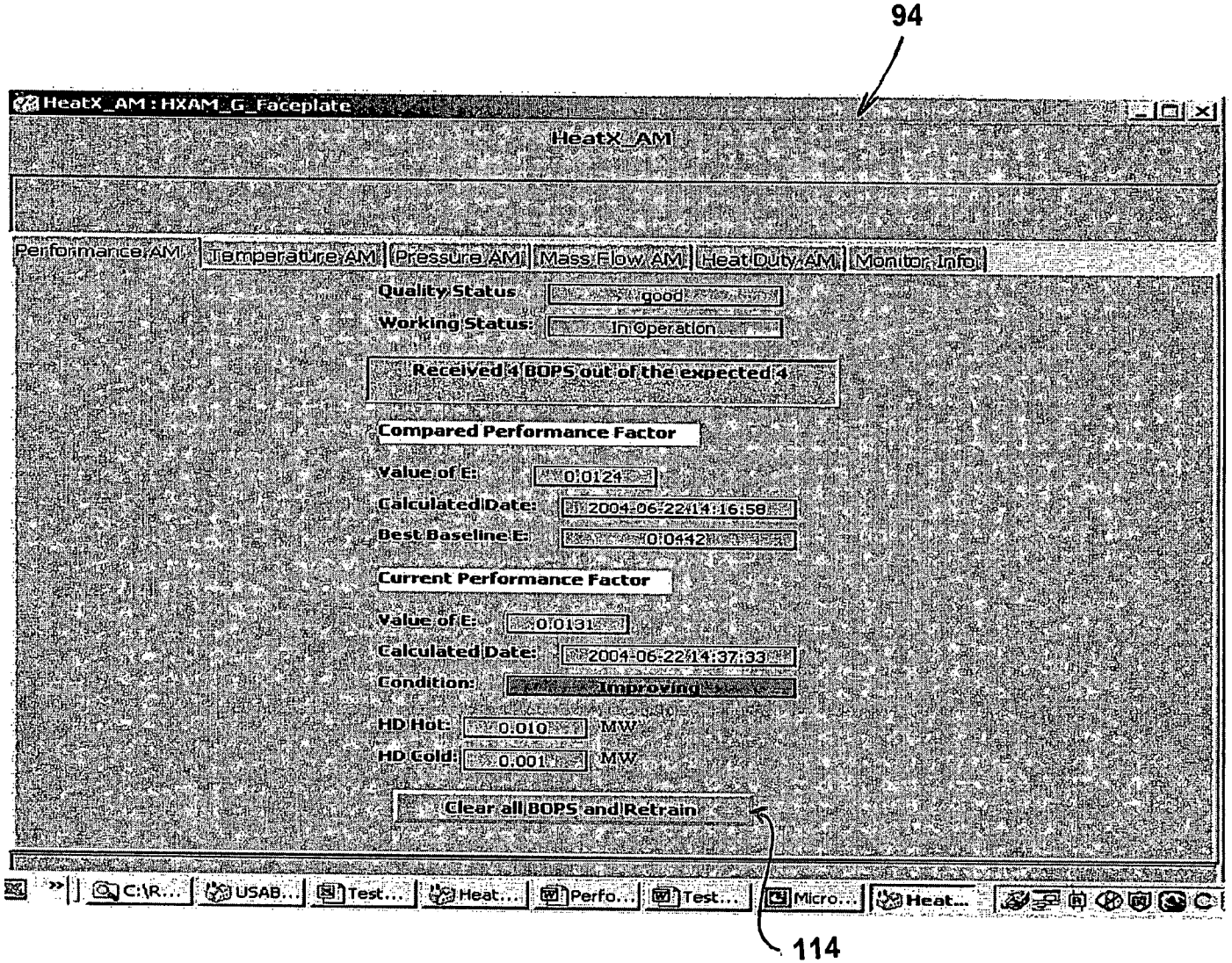
FIG. 5 is a view of a screen on the computer monitor of the monitoring system showing an asset faceplate.

Referring now to FIG. 4, there is shown a view 112 that may be displayed on the monitor 64 of the work station 52 during the operation of the HXAM 72. The view 112 is divided into three frames, namely an asset frame 112*a*, an aspect frame 112*b* and a list frame 112*c*. The asset viewer 90 is displayed in the asset frame 112*a*, while the asset recorder 92 is displayed in the aspect frame 112*b* and an aspect list 113 is displayed in the list frame 112*c*. Other aspects of the HXAM 12, such as the asset faceplate 94, can be displayed in the aspect frame 112*b* by selecting the aspect from the aspect list 113. With reference now to FIG. 5, the asset faceplate 94 includes the status of the HXAM 72, e.g. "in operation", the value of $E^{BASELINE}$ used for the comparison with the newly calculated $E^{NEW}$ the date and time $E^{BASELINE}$ was calculated, the value of the best $E^{BASELINE}$ stored in the library, the value of $E^{NEW}$, the date and time that $E^{NEW}$ was calculated and the condition of the performance factor, e.g. "improving". The asset faceplate 94 also contains the pushbutton 114, which is a "clear" pushbutton that when clicked, clears all of the stored BOPS values and their corresponding $E^{BASELINE}$ values and initiates a new training operation.

In addition to, or in lieu of, the HXAM 72, the monitoring system 10 may be provided with a second heat exchanger asset monitor (HXAM) 116. The second HXAM 116 is specifically for use for a shell and tube heat exchanger. Thus, for purposes of describing the second HXAM 116, the heat exchanger 12 shall be presumed to have a shell and tube construction with a known tube surface area (A). The second HXAM 116 has substantially the same architecture and performs substantially the same functions as the HXAM 72. In addition, the second HXAM 116 monitors changes in the heat transfer efficiency (U) of the heat exchanger 12. The value of U is calculated as follows:

$$U = \frac{HD^{AVERAGE}}{(A \times LMTD^{CORRECTED})} \tag{11}$$

where, $$HD^{AVERAGE} = \frac{(HD^{HOT} + HD^{COLD})}{2}$$

$$LMTD^{CORRECTED} = F \times \frac{T^{DIFF}}{\ln(T^{DIV})}$$

"F" is a correction factor if the heat exchanger 12 is not a true counter-current heat exchanger and can be assumed to be equal to 1 for purposes of comparing U values.

If the heat exchanger 12 is a counter-current heat exchanger, then:

$$T^{DIFF}=((T^{HOT\text{-}IN}-T^{COLD\text{-}OUT})-(T^{HOT\text{-}OUT}-T^{COLD\text{-}IN}))$$

$$T^{DIV}=((T^{HOT\text{-}IN}-T^{COLD\text{-}OUT})\div(T^{HOT\text{-}OUT}-T^{COLD\text{-}IN}))$$

If the heat exchanger is a co-current heat exchanger, then:

$$T^{DIFF}=((T^{HOT\text{-}IN}-T^{COLD\text{-}IN})-(T^{HOT\text{-}OUT}-T^{COLD\text{-}OUT})$$

$$T^{DIV}=((T^{HOT\text{-}IN}-T^{COLD\text{-}IN})\div(T^{HOT\text{-}OUT}-T^{COLD\text{-}OUT}))$$

During the training period, values of U are calculated for the different BOPS (referred to herein as $U^{BASELINE}$). All of the calculated $U^{BASELINE}$ values are related to, or associated with, the BOPS values for which they were calculated and are stored in the library, together with their associated BOPS. Thus, the library typically contains a plurality of different $U^{BASELINE}$ values that are associated with a plurality of different BOPS values, respectively.

Each calculated $U^{BASELINE}$ value is compared to a value of U that the heat exchanger 12 is designed to have ($U^{DESIGN}$). If there is a substantial deviation between the $U^{BASELINE}$ value and the $U^{DESIGN}$ value, the second HXAM 116 transmits an asset condition document 86 to the HSI 66, notifying the HSI 66 that there is a substantial deviation between the $U^{BASELINE}$ value and the $U^{DESIGN}$ value.

After the training operation is completed, the second HXAM 116 periodically retrieves a set of current HX values and calculates U for the current HX values ($U^{NEW}$) using equation (11) above. In addition, the second HXAM 116 searches the library for a BOPS that at least substantially matches the set of current HX values. When the second HXAM 116 finds a substantially matching BOPS, the HXAM calculates ΔU(%) from the calculated $U^{NEW}$ and the $U^{BASELINE}$ for the substantially matching BOPS, using the equation:

$$\Delta U(\%) = 100 \times \frac{(U^{NEW} - U^{BASELINE})}{U^{BASELINE}} \tag{12}$$

If the calculated ΔU(%) is positive, zero, or negative by less than a first percentage amount (such as 2%) the second HXAM 116 does not issue an asset condition document 86. If, however, the calculated ΔU(%) is negative by more than the first percentage amount, the second HXAM 116 transmits an asset condition document 86 to the HSI 66, notifying the HSI 66 that the heat transfer efficiency of the heat exchanger 12 has declined. The second HXAM 116 also transmits an asset condition document 86 to the HSI 66 if $U^{NEW}$ is too low.

In addition to monitoring changes in U of the heat exchanger 12, the second HXAM 116 also monitors the limit approach temperature (LAT) of the heat exchanger 12. The second HXAM 116 periodically retrieves a set of current HX values and calculates LAT for the current HX values using the following equation:

$$LAT = T^{HOT-OUT} - \left(T^{COLD-OUT} + \left((T^{COLD-IN} - T^{COLD-OUT}) \times \frac{(T^{COLD-OUT} - T^{HOT-IN})}{(T^{HOT-OUT} - T^{HOT-IN})}\right)\right) \tag{13}$$

If a calculated LAT is above a predetermined level, the second HXAM 116 does not issue an asset condition document 86. If, however, the calculated LAT falls below the predetermined level, the second HXAM 116 transmits an asset condition document 86 to the HSI 66, notifying the HSI 66 that the LAT is below the predetermined level.

The second HXAM 116 also monitors the thermal profile of the heat exchanger 12 to determine if any shell is in thermal crossover, i.e., for any shell, the temperature of the hot fluid at the outlet is less than the temperature of the cold fluid at the outlet. If the heat exchanger 12 has a plurality of shells, a cross-over detection routine 120 is used to determine if any of the shells is in thermal cross-over. For purposes of explanation, the heat exchanger 12 is assumed to have N shells, including at least first, second and third shells, arranged in a serial manner and with known lengths L1, L2, L3 . . . LN. In the cross-over detection routine, the second HXAM 116 uses $T^{HOT-IN}$, $T^{HOT-OUT}$ and the total shell length ($S^{TOTAL}$) to express the temperature of the hot fluid ($T^{HOT}$) as a linear function of the shell length (S) pursuant to the equation:

$$T^{HOT} = T^{HOT-IN} - S \times \frac{T^{HOT-IN} - T^{HOT-OUT}}{S^{TOTAL}} \tag{14}$$

and uses $T^{COLD-IN}$, $T^{COLD-OUT}$ and total shell length ($S^{TOTAL}$) to express the temperature of the cold fluid ($T^{COLD}$) as a linear function of the shell length (S) pursuant to the equation:

$$T^{COLD} = T^{COLD-OUT} - S \times \frac{T^{COLD-OUT} - T^{COLD-IN}}{S^{TOTAL}}. \tag{15}$$

Figure 6:
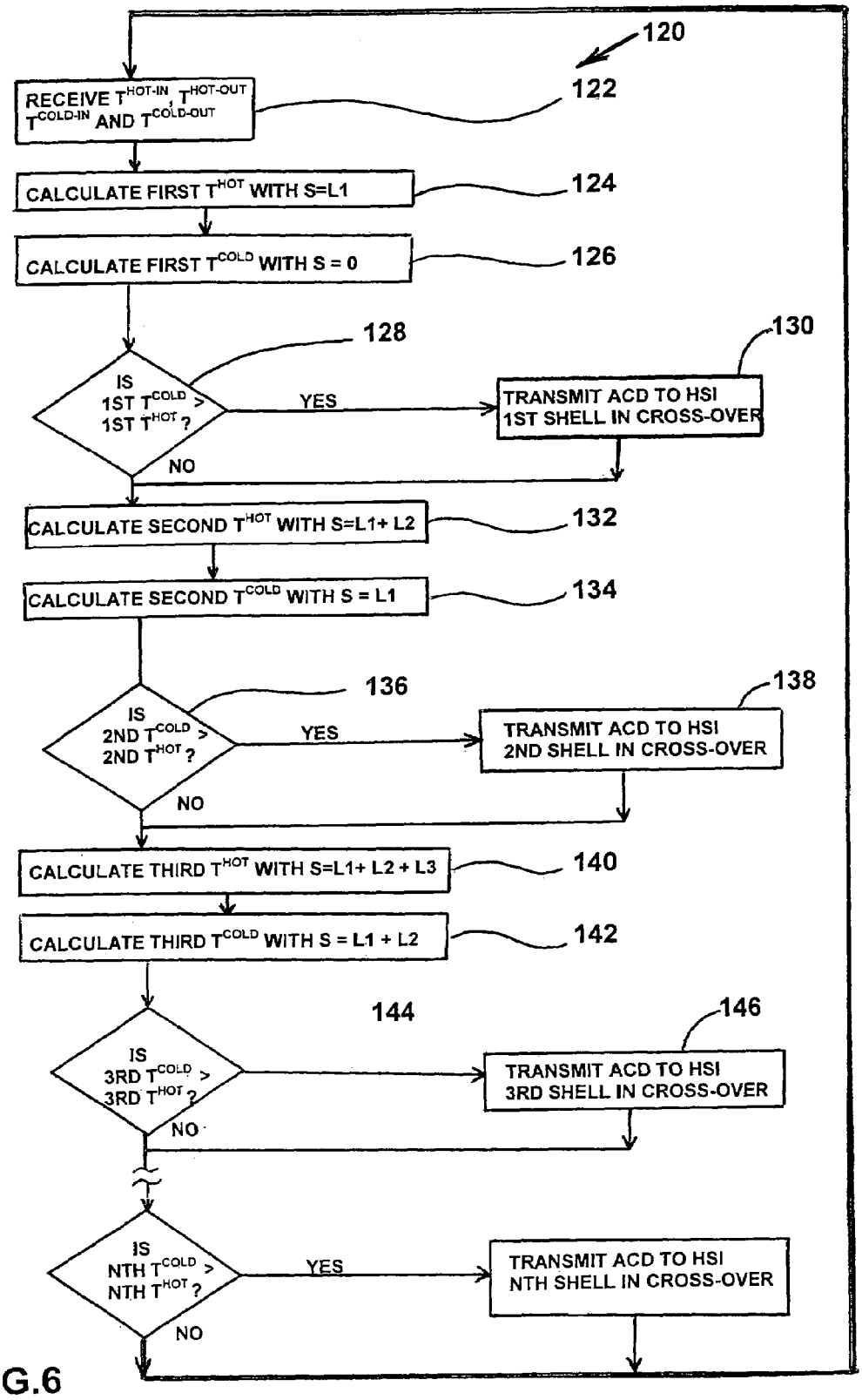
FIG. 6 is a flow diagram of a method of monitoring the performance of the heat exchanger.

Referring now to FIG. 6, in an initial step 122 of the cross-over detection routine 120, the routine receives values of $T^{HOT-IN}$, $T^{HOT-OUT}$, $T^{COLD-IN}$ and $T^{COLD-OUT}$. The routine 120 then proceeds to step 124, wherein the routine 120 calculates a first $T^{HOT}$ using equation (14) and S=L1 and then moves to step 126, wherein the routine 120 calculates a first $T^{COLD}$ using equation (15) and S=0. After step 126, the routine 120 compares the first $T^{COLD}$ to the first $T^{HOT}$ in step 128. If the first $T^{COLD}$ is greater than the first $T^{HOT}$, then the routine 120 proceeds to step 130, wherein the routine 120 transmits an asset condition document 86 to the HSI 66, notifying the HSI 66 that the first shell is in thermal cross-over. After step 130, the routine proceeds to step 132. If in step 128, the routine 120 determines that the first $T^{COLD}$ is not greater than the first $T^{HOT}$, then the routine 120 proceeds directly to step 132. The routine calculates a second $T^{HOT}$ in step 132 using equation (14) and S=L1+L2 and then proceeds to step 134, wherein the routine 120 calculates a second $T^{COLD}$ using equation (15) and S=L1. After step 134, the routine 120 compares the second $T^{COLD}$ to the second $T^{HOT}$ in step 136. If the second $T^{COLD}$ is greater than the second $T^{HOT}$, then the routine 120 proceeds to step 138, wherein the routine 120 transmits an asset condition document 86 to the HSI 66, notifying the HSI 66 that the second shell is in thermal cross-over. After step 138, the routine 120 proceeds to step 140. If in step 136, the routine 120 determines that the second $T^{COLD}$ is not greater than the second $T^{HOT}$, then the routine 120 proceeds directly to step 140. The routine 120 calculates a third $T^{HOT}$ in step 140 using equation (14) and S=L1+L2+L3 and then proceeds to step 142, wherein the routine 120 calculates a third $T^{COLD}$ using equation (15) and S=L1+L2. After step 142, the routine 120 compares the third $T^{COLD}$ to the third $T^{HOT}$ in step 144. If the third $T^{COLD}$ is greater than the third $T^{HOT}$, then the routine 120 proceeds to step 146, wherein the routine 120 transmits an asset condition document 86 to the HSI 66, notifying the HSI 66 that the third shell is in thermal cross-over. The routine 120 proceeds in the foregoing manner for the remaining shells and terminates after the $N^{th}$ $T^{COLD}$ is compared to the $N^{th}$ $T^{HOT}$ and an asset condition document 86 is transmitted to the HSI 66 notifying the HSI 66 that the $N^{th}$ is in thermal cross-over (if such is the case).

In addition to the foregoing, the second HXAM 116 may monitor the mass flow of the fluid through the shells ($W^{HOT}$ or $W^{COLD}$, as the case may be) and the average tube velocity (V) of the fluid flowing through tubes in the heat exchanger 12 (presuming the total cross-sectional area of the tubes ($A^{CROSS}$) is known and the field devices provide the volumetric flow of the fluid through the tubes ($F^{-VOL}$)). The average velocity, V, is calculated pursuant to the equation:

$$V = \frac{F^{-VOL}}{A^{CROSS}} \tag{16}$$

If a calculated V is within a predetermined range, the second HXAM 116 does not issue an asset condition document 86. If, however, the calculated V falls outside the predetermined level, the second HXAM 116 transmits an asset condition document 86 to the HSI 66, notifying the HSI 66 that V is high or low, as the case may be. If ($W^{HOT}$ or $W^{COLD}$ as the case may be) is above a predetermined level, the second HXAM 116 does not issue an asset condition document 86. If, however, ($W^{HOT}$ or $W^{COLD}$, as the case may be) falls below the predetermined level, the second HXAM 116 transmits an asset condition document 86 to the HSI 66, notifying the HSI 66 that the flow through the shell is low.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A system for monitoring the performance of a heat exchanger having hot and cold legs through which hot and cold fluids flow, respectively, said hot leg having a hot inlet and a hot outlet and said cold leg having a cold inlet and a cold outlet, said system comprising:

a communication link;

a plurality of field devices connected to the heat exchanger and operable to measure operating values of the heat exchanger and to transmit the operating values over the communication link, said operating values including the temperature of the hot fluid at the hot inlet ($T^{HOT-IN}$), the temperature of the hot fluid at the hot outlet ($T^{HOT-OUT}$), the temperature of the cold fluid at the cold inlet ($T^{COLD-IN}$) and the temperature of the cold fluid at the cold outlet ($T^{COLD-OUT}$);

a computer connected to the communication link;

a software program operable to run on the computer to execute a sequence of instructions including:

(a.) performing a training operation comprising:

(a1.) receiving baseline sets of the operating values of the heat exchanger from the communication link;

(a2.) calculating baseline values of a performance factor (E) for the baseline sets of the operating values, respectively; and (a3.) storing the baseline values of E and the baseline sets of the operating values they correspond to;

(b.) after the training operation, receiving a current set of the operating values from the communication link;

(c.) calculating a current value of E for the current set of the operating values;

(d.) retrieving a baseline value of E for a baseline set of the operating values that substantially matches the current set of the operating values; and (e.) comparing the current value of E to the retrieved baseline value of E to obtain a measure of any change in performance of the heat exchanger; and wherein E provides a measure of the performance of the heat exchanger and is calculated using $T^{HOT-IN}$, $T^{HOT-OUT}$, $T^{COLD-IN}$ and $T^{COLD-OUT}$.

2. The system of claim 1, wherein the software program calculates E using an equation selected from the group consisting of:

$$E=(\Delta T^{HOT}\times\Delta T^{COLD})\div(\Delta T^{X})^2; \tag{i.}$$

$$E=(\Delta T^{HOT-EFF}\times\Delta T^{COLD})\div(\Delta T^{X-H-EFF})^2; \tag{ii.}$$

$$E=(\Delta T^{HOT}\times\Delta T^{COLD-EFF})\div(\Delta T^{X-C-EFF})^2; \text{ and} \tag{iii.}$$

$$E=(\Delta T^{HOT-EFF}\times\Delta T^{COLD-EFF})\div(\Delta T^{X-HC-EFF})^2, \tag{iv.}$$

where, $$\Delta T^{HOT}=T^{HOT-IN}-T^{HOT-OUT}$$

$$\Delta T^{COLD}=T^{COLD-OUT}-T^{COLD-IN}$$

$$\Delta T^{X}=T^{HOT-IN}-T^{COLD-IN}$$

$$\Delta T^{HOT-EFF}=\Delta T^{HOT}+T^{HOT-VAP-CORR}$$

$$\Delta T^{X-H-EFF}=(T^{HOT-IN}+T^{HOT-VAP-CORR})-T^{COLD-IN}$$

$$T^{HOT-VAP-CORR}=C^{HOT-VAP}\div C^{HOT}$$

$C^{HOT}$ is the specific heat of the hot fluid $C^{HOT-VAP}$ is the heat of vaporization for the hot fluid $$\Delta T^{COLD-EFF}=\Delta T^{COLD}+T^{COLD-VAP-CORR}$$

$$\Delta T^{X-C-EFF}=T^{HOT-IN}-T^{COLD-IN}+T^{COLD-VAP-CORR}$$

$$T^{COLD-VAP-CORR}=C^{COLD-VAP}\div C^{COLD}$$

$C^{COLD}$ is the specific heat of the cold fluid $C^{COLD-VAP}$ is the heat of vaporization for the cold fluid $$\Delta T^{X-HC-EFF}=T^{HOT-IN}+T^{HOT-VAP-CORR}-T^{COLD-IN}+T^{COLD-VAP-CORR}.$$

3. The system of claim 2, wherein if the heat exchanger is single-phase for both the hot and cold fluids, then E is calculated using equation (i.), wherein if the beat exchanger is two-phase only for the hot fluid, with the hot fluid condensing, then E is calculated using equation (ii.), wherein if the heat exchanger is two-phase only for the cold fluid, with the cold fluid evaporating, then E is calculated using equation (iii.), and wherein if the heat exchanger is two-phase for both the hot and cold fluids, with the hot fluid condensing and the cold fluid evaporating, then E is calculated using equation (iv.).

4. The system of claim 2, wherein the operating values measured by the field devices further includes the mass flow rate of the hot fluid flowing through the hot leg ($W^{HOT}$) and the mass flow rate of the cold fluid flowing through the cold leg ($W^{COLD}$), and wherein the software program determines that a baseline set of the operating values at least substantially matches the current set of the operating values using an evaluation criteria based on differences in the $T^{HOT-OUT}$, $T^{COLD-OUT}$, $W^{HOT}$, $W^{COLD}$, $\Delta T^{HOT}$, $\Delta T^{COLD}$ values between the baseline set of the operating values and the current set of the operating values.

5. The system of claim 4, wherein in the evaluation criteria, differences in the $T^{HOT-OUT}$, $T^{COLD-OUT}$, $W^{HOT}$, $W^{COLD}$, $\Delta T^{HOT}$, $\Delta T^{COLD}$ values between the baseline set of the operating values and the current set of the operating values are respectively assigned a weighted number if the difference is less than a certain percentage, and are assigned a zero if the difference is greater than the certain percentage, and wherein all the numbers assigned to the differences are added up and if the sum is greater than a threshold level, the baseline set of the operating values is determined to at least substantially match the current set of the operating values.

6. The system of claim 2, wherein instructions (b) Through (e) are repeated according to a sample interval.

7. The system of claim 6, wherein the current value of E ($E^{NEW}$) is compared to the retrieved baseline value of E ($E^{BASELINE}$) using the equation:

$$\Delta E(\%) = 100 \times \frac{(E^{NEW} - E^{BASELINE})}{E^{BASELINE}}.$$

8. The system of claim 7, wherein the computer comprises a monitor and wherein if ΔE(%) is negative by more than a certain percentage, an alarm is displayed on the monitor, indicating that the performance of the heat exchanger has declined.

9. The system of claim 7, wherein if the calculated ΔE(%) is positive by more than a certain percentage for a certain number of sample intervals, with $E^{BASELINE}$ and $E^{NEW}$ remaining the same, then the $E^{BASELINE}$ and its associated baseline set of the operating values are replaced by $E^{NEW}$ and its associated current set of the operating values.

10. A method of monitoring the performance of a heat exchanger having hot and cold legs through which hot and cold fluids flow, respectively, said hot leg having a hot inlet and a hot outlet and said cold leg having a cold inlet and a cold outlet, said method comprising the steps of:

(a.) measuring operating values of the heat exchanger, said operating values including the temperature of the hot fluid at the hot inlet ($T^{HOT-IN}$), the temperature of the hot fluid at the hot outlet ($T^{HOT-OUT}$), the temperature of the cold fluid at the cold inlet ($T^{COLD-IN}$) and the temperature of the cold fluid at the cold outlet ($T^{COLD-OUT}$);

(b.) performing a training operation comprising:

(b1.) calculating baseline values of a performance factor (E) for baseline sets of the operating values, respectively; and (b2.) storing the baseline values of E and the baseline sets of the operating values they correspond to;

(c.) after the training operation, receiving a current set of the operating values;

(d.) calculating a current value of E for the current set of the operating values;

(e.) retrieving a baseline value of E for a baseline set of the operating values that substantially matches the current set of the operating values; and (f.) comparing the current value of E to the retrieved baseline value of E to obtain a measure of any change In performance of the heat exchanger;

wherein E provides a measure of the performance of the heat exchanger and is calculated using $T^{HOT-IN}$, $T^{HOT-OUT}$, $T^{COLD-IN}$ and $T^{COLD-OUT}$ and, displaying the obtained measurement of the performance of the heat exchanger.

11. The method of claim 10, wherein E is calculated using an equation selected from the group consisting of:

$$E=(\Delta T^{HOT} \times \Delta T^{COLD}) \div (\alpha T^{X})^2; \quad \text{(i.)}$$

$$E=(\Delta T^{HOT-EFF} \times \Delta T^{COLD}) \div (\Delta T^{X-H-EFF})^2; \quad \text{(ii.)}$$

$$E=(\Delta T^{HOT} \times \Delta T^{COLD-EFF}) \div (\Delta T^{X-C-EFF})^2; \text{ and} \quad \text{(iii.)}$$

$$E=(\Delta T^{HOT-EFF} \times \Delta T^{COLD-EFF}) \div (\Delta T^{X-HC-EFF})^2, \quad \text{(iv.)}$$

where, $$\Delta T^{HOT-IN} - T^{HOT-OUT}$$

$$\Delta T^{COLD} = T^{COLD-OUT} - T^{COLD-IN}$$

$$\Delta T^{X} = T^{HOT-IN} - T^{COLD-IN}$$

$$\Delta T^{HOT-EFF} = \Delta T^{HOT} + T^{HOT-VAP-CORR}$$

$$\Delta T^{X-H-EFF} = (T^{HOT-IN} + T^{HOT-VAP-CORR}) = T^{COLD-IN}$$

$$T^{HOT-VAP-CORR} = C^{HOT-VAP} \div C^{HOT}$$

$C^{HOT}$ is the specific heat of the hot fluid $C^{HOT-VAP}$ is the heat of vaporization for the hot fluid $$\Delta T^{COLD-EFF} = \Delta T^{COLD} + T^{COLD-VAP-CORR}$$

$$\Delta T^{X-C-EFF} = T^{HOT-IN} - T^{COLD-IN} + T^{COLD-VAP-CORR}$$

$$T^{COLD-VAP-CORR} = C^{COLD-VAP} \div C^{COLD}$$

$C^{COLD}$ is the specific heat of the cold fluid $C^{COLD-VAP}$ is the heat of vaporization for the cold fluid $$\Delta T^{X-HC-EFF} = T^{HOT-IN} + T^{HOT-VAP-CORR} - T^{COLD-IN} + T^{COLD-VAP-CORR}.$$

12. The method of claim 11, wherein if the heat exchanger is single-phase for both the hot and cold fluids, then E is calculated using equation (i.), wherein if the heat exchanger is two-phase only for the hot fluid, with the hot fluid condensing, then E is calculated using equation (ii.), wherein if the heat exchanger is two-phase only for the cold fluid, with the cold fluid evaporating, then E is calculated using equation (iii.), and wherein if the heat exchanger is two-phase for both the hot and cold fluids, with the hot fluid condensing and the cold fluid evaporating, then E is calculated using equation (iv.).

13. The method of claim 11, wherein each of the sets of the operating values further includes the mass flow rate of the hot fluid flowing through the hot leg ($W^{HOT}$) and the mass flow rate of the cold fluid flowing through the cold leg ($W^{COLD}$), and wherein a baseline set of the operating values is determined to at least substantially match the current set of the operating values using an evaluation criteria based on differences in the $T^{HOT-OUT}$, $T^{COLD-OUT}$, $W^{HOT}$, $W^{COLD}$, $\Delta T^{HOT}$, $\Delta T^{COLD}$ values between the baseline set of the operating values and the current set of the operating values.

14. The method of claim 13, wherein in the evaluation criteria, differences in the $T^{HOT-OUT}$, $T^{COLD-OUT}$, $W^{HOT}$, $W^{COLD}$, $\Delta T^{HOT}$, $\Delta T^{COLD}$ values between the baseline set of the operating values and the current set of the operating values are respectively assigned a weighted number if the difference is less than a certain percentage, and are assigned a zero if the difference is greater than the certain percentage, and wherein all the numbers assigned to the differences are added up and if the sum is greater than a threshold level, the baseline set of the operating values is determined to at least substantially match the current set of the operating values.

15. The method of claim 11, wherein steps (c) through (f) are repeated according to a sample interval.

16. The method of claim 15, wherein the current value of E ($E^{NEW}$) is compared to the retrieved baseline value of E ($E^{BASELINE}$) using the equation:

$$\Delta E(\%) = 100 \times \frac{(E^{NEW} - E^{BASELINE})}{E^{BASELINE}}.$$

17. The method of claim 16, further comprising: determining if ΔE(%) is negative by more than a certain percentage, and if so, displaying alarm indicating that the performance of the heat exchanger has declined.

18. The method of claim 16, further comprising: determining if the calculated ΔE(%) is positive by more than a certain percentage for a certain number of sample intervals, with $E^{BASELINE}$ and $E^{NEW}$ remaining the same, and if so, replacing the $E^{BASELINE}$ and its associated baseline set of the operating values with the $E^{NEW}$ and its associated current set of the operating values.

19. The method of claim 10, wherein after step (b.), if a stored baseline set of the operating values is not detected for a certain period of time, then the stored baseline set of the operating values and the stored baseline value of E therefor are removed from storage.

20. The method of claim 10, wherein after step (b.), if all of the stored baseline sets of the operating values are not detected for a certain period of time, then all of the stored baseline sets of the operating values and the stored baseline values of E therefor are removed from storage and step (b.) is performed again to calculate new baseline values of S for new baseline sets of the operating values, respectively, and to store the new baseline values of E and the new baseline sets of the operating values they correspond to.

21. A method of monitoring the performance of a heat exchanger having hot and cold legs through which hot and cold fluids flow, respectively, said hot leg having a hot inlet and a hot outlet and said cold leg having a cold inlet and a cold outlet, said method comprising the steps of:

(a.) measuring operating values of the heat exchanger, said operating values including the temperature of the hot fluid at the hot inlet ($T^{HOT-IN}$), the temperature of the hot fluid at the hot outlet ($T^{HOT-OUT}$), the temperature of the cold fluid at the cold inlet ($T^{COLD-IN}$) and the temperature of the cold fluid at the cold outlet ($T^{COLD-OUT}$);

(b.) calculating a baseline value of a performance factor (E) for a baseline set of the operating values;

(c.) storing the baseline value of E;

(d.) receiving a current set of the operating values;

(e.) calculating a current value of E for the current set of the operating values; and (f.) comparing the current value of E to the baseline value of E to obtain a measure of any change in performance of the heat exchanger;

wherein E provides a measure of the performance of the heat exchanger and is calculated using an equation selected from the group consisting of:

$$E=(\Delta T^{HOT}\times\Delta T^{COLD})\div(\alpha T^{X})^2; \quad \text{(i.)}$$

$$E=(\Delta T^{HOT-EFF}\times\Delta T^{COLD})\div(\Delta T^{X-H-EFF})^2; \quad \text{(ii.)}$$

$$E=(\Delta T^{HOT}\times\Delta T^{COLD-EFF})\div(\Delta T^{X-C-EFF})^2; \text{ and} \quad \text{(iii.)}$$

$$E=(\Delta T^{HOT-EFF}\times\Delta T^{COLD-EFF})+(\Delta T^{X-HC-EFF})^2, \quad \text{(iv.)}$$

where, $$\Delta T^{HOT-IN}-T^{HOT-OUT}$$

$$\Delta T^{COLD}=T^{COLD-OUT}-T^{COLD-IN}$$

$$\Delta T^{X}=T^{HOT-IN}-T^{COLD-IN}$$

$$\Delta T^{HOT-EFF}=\Delta T^{HOT}+T^{HOT-VAP-CORR}$$

$$\Delta T^{X-H-EFF}=(T^{HOT-IN}+T^{HOT-VAP-CORR})=T^{COLD-IN}$$

$$T^{HOT-VAP-CORR}=C^{HOT-VAP}\div C^{HOT}$$

$C^{HOT}$ is the specific heat of the hot fluid $C^{HOT-VAP}$ is the heat of vaporization for the hot fluid $$\Delta T^{COLD-EFF}=\Delta T^{COLD}+T^{COLD-VAP-CORR}$$

$$\Delta T^{X-C-EFF}=T^{HOT-IN}-T^{COLD-IN}+T^{COLD-VAP-CORR}$$

$$T^{COLD-VAP-CORR}=C^{COLD-VAP}\div C^{COLD}$$

$C^{COLD}$ is the specific heat of the cold fluid $C^{COLD-VAP}$ is the heat of vaporization for the cold fluid $$\Delta T^{X-HC-EFF}=T^{HOT-IN}+T^{HOT-VAP-CORR}-T^{COLD-IN}+T^{COLD-VAP-CORR}$$

and, displaying the obtained measurement of the performance of the heat exchanger.

22. The method of claim 21, wherein if the heat exchanger is single-phase for both the hot and cold fluids, then E is calculated using equation (i.), wherein if the heat exchanger is two-phase only for the hot fluid, with the hot fluid condensing, then E is calculated using equation (ii.), wherein it the heat exchanger is two-phase only for the cold fluid, with the cold fluid evaporating, then E is calculated using equation (iii.), and wherein if the heat exchanger is two-phase for both the hot and cold fluids, with the hot fluid condensing and the cold fluid evaporating, then E is calculated using equation (iv.).

23. The method of claim 21, wherein the current value of E ($E^{NEW}$) is compared to the baseline value of E ($E^{BASELINE}$) using the equation:

$$\Delta E(\%) = 100 \times \frac{(E^{NEW} - E^{BASELINE})}{E^{BASELINE}}$$

and wherein the method further comprises determining if ΔE(%) is negative by more than a certain percentage, and it so, displaying alarm indicating that the performance of the heat exchanger has declined.

24. The method of claim 21, wherein the baseline set of the operating values substantially matches the current set of the operating values.

* * * * *